US012402648B2

(12) United States Patent
Duc et al.

(10) Patent No.: US 12,402,648 B2
(45) Date of Patent: Sep. 2, 2025

(54) AEROSOL GENERATING ARTICLE WITH HEAT-EXPANDABLE CENTERING ELEMENT

(71) Applicant: Philip Morris Products S.A., Neuchatel (CH)

(72) Inventors: Fabien Duc, Neuchatel (CH); Alexandre Malgat, Neuchatel (CH); Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 1195 days.

(21) Appl. No.: 16/766,471

(22) PCT Filed: Dec. 6, 2018

(86) PCT No.: PCT/EP2018/083883

§ 371 (c)(1),
(2) Date: May 22, 2020

(87) PCT Pub. No.: WO2019/110768

PCT Pub. Date: Jun. 13, 2019

(65) Prior Publication Data

US 2020/0375243 A1 Dec. 3, 2020

(30) Foreign Application Priority Data

Dec. 7, 2017 (EP) ..... 17205992

(51) Int. Cl.

| | |
|---|---|
| ***A24D 1/20*** | (2020.01) |
| ***A24D 1/02*** | (2006.01) |
| ***A24F 40/46*** | (2020.01) |
| *A24F 40/20* | (2020.01) |

(52) U.S. Cl.
CPC ..... *A24D 1/02* (2013.01); *A24D 1/025* (2013.01); *A24D 1/20* (2020.01); *A24F 40/46* (2020.01); *A24F 40/20* (2020.01)

(58) Field of Classification Search
None
See application file for complete search history.

(56) References Cited

U.S. PATENT DOCUMENTS 3,030,963 A * 4/1962 Cohn ..... A24D 1/12 D27/101
4,967,774 A 11/1990 White
(Continued)

FOREIGN PATENT DOCUMENTS

CN 104023568 A 9/2014
CN 105208881 A 12/2015
(Continued)

OTHER PUBLICATIONS

Japanese Office Action issued Jan. 23, 2023 in Japanese Patent Application No. 2020-526400 (with English Translation), 9 pages.
(Continued)

*Primary Examiner* — Dionne W. Mayes
(74) *Attorney, Agent, or Firm* — Oblon, McClelland, Maier & Neustadt, L.L.P.

(57) ABSTRACT

An aerosol-generating article for producing an inhalable aerosol when heated is provided, the aerosol-generating article including: a rod of aerosol-generating substrate; a wrapper circumscribing at least the rod; and at least one heat-expandable element disposed on an outer surface of the wrapper. An aerosol-generating system is also provided, including the aerosol aerosol-generating article and an electrically operated aerosol-generating device.

15 Claims, 2 Drawing Sheets

(56) References Cited

U.S. PATENT DOCUMENTS

| | | | | |
|---|---|---|---|---|
| 5,060,675 | A * | 10/1991 | Milford et al. | A24D 1/02 131/365 |
| 5,074,321 | A * | 12/1991 | Gentry et al. | A24D 1/18 131/365 |
| 5,388,594 | A | 2/1995 | Counts et al. | |
| 5,666,978 | A | 9/1997 | Counts et al. | |
| 6,883,523 | B2 | 4/2005 | Dante | |
| 2004/0016427 | A1 | 1/2004 | Byron et al. | |
| 2005/0051185 | A1 | 3/2005 | Rasouli et al. | |
| 2007/0074734 | A1* | 4/2007 | Braunshteyn et al. | A24F 40/51 131/194 |
| 2010/0223878 | A1* | 9/2010 | Lipka et al. | C09D 5/185 428/447 |
| 2013/0019888 | A1 | 1/2013 | Tsuruizumi et al. | |
| 2016/0029692 | A1 | 2/2016 | Duggan et al. | |
| 2017/0303585 | A1 | 10/2017 | Florack et al. | |
| 2019/0029314 | A1 | 1/2019 | Malgat et al. | |
| 2019/0029315 | A1 | 1/2019 | Malgat | |

FOREIGN PATENT DOCUMENTS

| | | | | |
|---|---|---|---|---|
| CN | 106455684 | A | 2/2017 | |
| CN | 107427081 | A | 12/2017 | |
| JP | 7-184627 | A | 7/1995 | |
| JP | 11-503912 | A | 4/1999 | |
| KR | 10 2007 054788 | A | 5/2007 | |
| KR | 10-0728489 | B1 | 6/2007 | |
| RU | 2015 140 135 | A | 3/2017 | |
| WO | WO 96/32854 | A2 | 10/1996 | |
| WO | WO 2012/164009 | A2 | 12/2012 | |
| WO | WO 2015/082648 | A1 | 6/2015 | |
| WO | WO 2016/050706 | A1 | 4/2016 | |
| WO | WO 2017/042297 | A1 | 3/2017 | |
| WO | WO 2017/042298 | A1 | 3/2017 | |
| WO | WO 2017/115196 | A1 | 7/2017 | |
| WO | WO 2017114760 | * | 7/2017 | A24D 1/10 |

OTHER PUBLICATIONS

Combined Russian Office Action and Search Report issued Dec. 14, 2021 in corresponding Russian Patent Application No. 2020121792/03 (with English Translation), 11 pages.

International Search Report and Written Opinion issued Mar. 14, 2019 in PCT/EP2018/083883 filed Dec. 6, 2018.

Combined Chinese Office Action and Search Report issued Jan. 21, 2022 in Chinese Patent Application No. 201880073688.2 (with English translation), 12 pages.

* cited by examiner

AEROSOL GENERATING ARTICLE WITH HEAT-EXPANDABLE CENTERING ELEMENT

The present invention relates to an aerosol generating article comprising an aerosol-generating substrate.

Aerosol-generating articles in which an aerosol-generating substrate, such as a tobacco-containing substrate, is heated rather than combusted, are known in the art. Typically in such heated aerosol-generating articles, an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

Several alternative methods are available for producing substrates for heated aerosol-generating articles, such as from randomly oriented shreds, strands, or strips of tobacco material. More recently, WO-A-2012/164009 has disclosed rods for heated aerosol-generating articles formed from gathered sheets of homogenised tobacco material, which allow for a better control of porosity along the rods.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. The aerosol-generating device may, for example, comprise a heating chamber adapted to removably receive an aerosol-generating substrate that can be inserted by a user, and removed by the user after use. In such devices, the aerosol-generating substrate may therefore receive heat from a surrounding surface of the heating chamber.

To facilitate insertion and removal of the aerosol-generating article, an internal diameter of the heating chamber is preferably greater than an outer diameter of the aerosol-generating article. This is also desirable in that it helps account for possible slight variations in the outer diameter of the aerosol-generating article. By contrast, if an internal diameter of the heating chamber were very similar to an outer diameter of the aerosol-generating article, fluctuations in the outer diameter of the aerosol-generating article may prevent it from being inserted into the device, and in general portions of the aerosol-generating article may be in direct contact or even pressed against heating surfaces, which may cause local overheating or even burning of the aerosol-generating article.

Besides, it has been found that, in general, a smaller amount of aerosol-generating substrate is needed in heated aerosol-generating articles compared with aerosol-generating articles wherein the substrate is combusted, such as conventional filter cigarettes. Thus, aerosol-generating articles for producing an inhalable aerosol when heated may have a diameter similar to the diameter of a conventional filter cigarette, whilst being shorter than a conventional filter cigarette. Alternatively, aerosol-generating articles for producing an inhalable aerosol when heated may have roughly the same length of a conventional filter cigarette, whilst being slimmer than a conventional filter cigarette.

Aerosol-generating articles of the slimmer type can be heated quickly, as there is less material to heat per length unit. Further, it may be possible to independently heat different longitudinal portions of the aerosol-generating substrate in succession, which may enable a fine management of how the aerosol-generating substrate is consumed over time.

However, slimmer aerosol-generating articles are less suitable for use with an internal heating mechanism, which is one where a heating element, such as a heater blade, is inserted into the aerosol-generating substrate. This is because insertion of the heating element into the aerosol-generating substrate may damage the substrate or the heating element itself.

When used in a device comprising a heating chamber adapted to receive the aerosol-generating article, though, slimmer aerosol-generating articles are more prone to sliding out of the heating chamber and are typically not held in an ideally centred position within the heating chamber, and so the supply of thermal energy to the aerosol-generating substrate may not be as homogenous as possible.

It would be desirable to provide an alternative aerosol-generating article that is easier to hold in position during use, whilst also being easy to insert into a heating chamber of an aerosol-generating device. Further, it would be desirable to provide one such aerosol-generating article that can be conveniently manufactured at high speed without requiring any major modification of existing apparatus.

According to an aspect of the present invention there is provided an aerosol-generating article for producing an inhalable aerosol when heated. The aerosol-generating article comprises a rod of aerosol-generating substrate; a wrapper circumscribing at least the rod; and at least one heat-expandable element disposed on the outer surface of the wrapper.

According to a further aspect of the present invention there is provided an aerosol-generating system comprising an aerosol aerosol-generating article and an electrically operated aerosol-generating device, wherein the aerosol-generating device comprises a heater and an elongate heating chamber configured to receive the aerosol-generating article so that the aerosol-generating article is heated in the heating chamber. The aerosol-generating article comprises a rod of aerosol-generating substrate; a wrapper circumscribing at least the rod, wherein an outer diameter of the circumscribed rod is less than an inner diameter of the heating chamber; and at least one heat-expandable element disposed on the outer surface of the wrapper. The heat-expandable element is configured to deform when heated in the heating chamber, such that at least part of the heat-expandable element engages an inner surface of the heating chamber.

It will be appreciated that any features described with reference to one aspect of the present invention are equally applicable to any other aspect of the invention.

The term "aerosol generating article" is used herein to denote both articles wherein an aerosol generating substrate is heated and articles wherein an aerosol generating substrate is combusted, such as conventional cigarettes. As used herein, the term "aerosol generating substrate" denotes a substrate capable of releasing volatile compounds upon heating to generate an aerosol.

In heated aerosol generating articles, an aerosol is generated by heating a flavour generating substrate, such as tobacco, without combustion. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising a device including a heating chamber adapted to receive at least a portion of the rod of aerosol generating substrate. As used herein, the term "aerosol generating device" refers to a device comprising a heater element that interacts with the aerosol generating substrate of the aerosol generating article to generate an aerosol.

As used herein, the terms "upstream" and "downstream" describe the relative positions of elements, or portions of elements, of the aerosol-generating article in relation to the direction in which the aerosol is transported through the aerosol-generating article during use.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

In the context of the present invention, the term "heat-expandable" is used to describe a material or component the length, surface area and volume of which increase in response to a change in temperature. In general, the "coefficient of thermal expansion" describes how the size of an object made from a certain material changes with a change in temperature. In other words, the coefficient of thermal expansion is an indication of the fractional change in size per degree change in temperature at a constant pressure. Reference may be made to several types of coefficients of thermal expansion have been developed: volumetric, area, and linear. Volumetric, area and linear thermal expansions are closely related.

As used herein, the term "intumescent material" is used to describe a material that expands upon exposure to elevated temperatures, other than only as a result of its coefficient of thermal expansion. By way of example, upon reaching a predetermined temperature, an intumescent material may swell significantly and rapidly due to a chemical process initiated by heat.

As briefly described above, an aerosol-generating article in accordance with the present invention comprises a rod of aerosol-generating substrate adapted to release an inhalable aerosol when heated. Further, the aerosol-generating article comprises a wrapper circumscribing at least the rod. In contrast to existing aerosol-generating articles, in accordance with the invention at least one heat-expandable element is disposed on the outer surface of the wrapper.

Thus, when during use the aerosol-generating article is exposed to heat, particularly when the aerosol-generating article is used in an aerosol-generating device of the type comprising a heating chamber adapted to at least partially receive the aerosol-generating article, the heat-expandable element undergoes a volumetric expansion. Accordingly, the outer diameter of the heat-expandable element increases and the aerosol-generating article may thus engage an inner surface of the heating chamber.

It is advantageously easy to ensure that an aerosol-generating article in accordance with the invention is stably held within the heating chamber of one such aerosol-generating device. Further, it is easy to ensure that during use an aerosol-generating article in accordance with the invention is maintained in a desirably centred position within the heating chamber, which ensures that heat is supplied as homogenously as possible to the aerosol-generating substrate during use.

Further, because the heat-expandable element ultimately engages the inner surface of the heating chamber, when the aerosol-generating article is removed from the heating chamber after use, the expanded element may advantageously help clean the surface of the heating chamber between uses.

At the same time, by engaging the inner surface of the heating chamber, the expanded element at least partially obstructs the gap otherwise provided between the aerosol-generating article and the inner surface of the heating chamber. Thus, the air flowing within such gap cannot effectively be drawn by the consumer towards the mouth end of the aerosol-generating device. This is advantageous because, by being in direct contact with the heated inner surface of the chamber, this air may become very hot and may potentially harm the consumer during use.

In addition, aerosol-generating articles in accordance with the present invention can advantageously be manufactured in a continuous process which can be efficiently carried out at high speed, and can be conveniently incorporated into existing production lines for the manufacture of heated smoking articles.

As briefly described above, an aerosol-generating article in accordance with the present invention comprises a rod of aerosol-generating substrate and a wrapper circumscribing at least the rod. In some embodiments, the wrapper circumscribes only the rod. In other embodiments, where the aerosol-generating article comprises one or more additional components in substantial alignment with the rod, the wrapper may at least partly circumscribe the one or more additional components, as well.

As used herein, the term "rod" is used to denote a generally cylindrical element of substantially circular, oval or elliptical cross-section.

The aerosol-generating substrate may be formed from shreds, strands, or strips of tobacco material, including sheets of reconstituted tobacco or homogenised tobacco. As used herein, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise one or more of tobacco dust, tobacco fines, and other particulate tobacco by-products formed during the treating, handling and shipping of tobacco as well as binder, aerosol formers, flavours, other non-tobacco materials, like other plant material, including fibres and others. The sheets of homogenised tobacco material may be produced by casting, extrusion, paper making processes or other any other suitable processes known in the art.

The continuous sheet of aerosol-forming material may be a smooth sheet. Alternatively, the continuous sheet may be treated to facilitate the gathering of the sheet. For example, the continuous sheet may be grooved, creased, folded, textured, embossed, or otherwise treated to provide lines of weakness to facilitate gathering. A preferred treatment for the continuous sheet is crimping. As used herein, the term "crimped" denotes a sheet having a plurality of substantially parallel ridges or corrugations. The inclusion of one or more crimped sheets may help to retain the spacing between adjacent sheets within the rod.

The sheets may be formed of a porous tobacco material. The term "porous" is used herein to refer to a material that provides a plurality of pores or openings that allow the passage of air through the material. The tobacco material may be produced within an inherent porosity so that sufficient pores or interstices are provided within the structure of each sheet to enable the flow of air through the sheet in a longitudinal direction. Alternatively or in addition, each sheet of tobacco material may comprise a plurality of air flow holes to provide the desired porosity. For example, the sheet of tobacco material may be punctured with a pattern of air flow holes during production of the rod of aerosol-generating substrate. The air flow holes may be punctured randomly or uniformly over the sheet. The pattern of air flow holes may cover substantially the full surface of the sheet, or may cover one or more specific areas of the sheet, with the remaining areas being free from air flow holes.

The shreds, strands or strips of tobacco material may be randomly arranged within the rod. As an alternative, the shreds, strands or strips of tobacco material may be substantially parallel and aligned with a longitudinal axis of the rod.

In some embodiments, the aerosol-generating substrate may be formed by gathering a continuous sheet of homogenised tobacco material transversely relative to a longitudinal axis.

Preferably the aerosol-generating substrate comprises an aerosol-former. As used herein, the term "aerosol former" describes any suitable known compound or mixture of compounds that, in use, facilitates formation of an aerosol and that is substantially resistant to thermal degradation at the operating temperature of the aerosol-generating article. Suitable aerosol-formers are known in the art and include, but are not limited to: polyhydric alcohols, such as propylene glycol, Methylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine.

The aerosol former may be provided as a liquid or a gel. In some embodiments, the aerosol former may be provided in a composition further comprising nicotine or a flavourant or both.

Homogenised tobacco materials may further include various other additives such as humectants, plasticisers, flavourants, fillers, binders and solvents.

The rod of aerosol generating substrate preferably has an external diameter that is approximately equal to the external diameter of the aerosol generating article.

Preferably, the rod of aerosol generating substrate has an external diameter of at least 5 millimetres. The rod of aerosol generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol generating substrate has an external diameter of 7.2 millimetres, to within 10 percent.

The rod of aerosol generating substrate may have a length of between about 5 millimetres and about 100 mm. Preferably, the rod of aerosol generating substrate has a length of at least about 5 millimetres, more preferably at least about 7 millimetres. In addition, or as an alternative, the rod of aerosol generating substrate preferably has a length of less than about 25 millimetres, more preferably less than about 20 millimetres. In one embodiment, the rod of aerosol generating substrate may have a length of about 10 millimetres. In a preferred embodiment, the rod of aerosol generating substrate has a length of about 12 millimetres.

Preferably, the rod of aerosol generating substrate has a substantially uniform cross-section along the length of the rod. Particularly preferably, the rod of aerosol generating substrate has a substantially circular cross-section.

Aerosol generating articles in accordance with the present invention comprise an aerosol generating substrate, which may be provided as a rod comprising strands of non-tobacco material circumscribed by a wrapper. As used herein, the term 'rod' is used to denote a generally cylindrical element of substantially circular, oval or elliptical cross-section. In principle, also other and more complicated cross-sections for the strands are possible, like star shaped, X-shaped or Y-shaped. However, in the context of the present invention, those cross-sectional shapes that allow a reasonably tight packing of the strands, but at the same time have a favourable ratio between the surface area of a circle circumscribed to the cross-section of the strand and the effective surface area of the cross-section of the strand are preferred. This is because, in the context of the present invention, shapes that enable packing a greater collective strand volume in the rod are generally preferred over shapes corresponding to greater collective outer surface areas of the strands. In this respect, a circular shape, or quasi-circular shape (such as oval or elliptical) is ideal. Triangular and rectangular cross-sections are also possible. However, with triangular and rectangular cross-sections, the strands may become packed even too tight, such as to reduce the space available for airflow among the strands.

As described above, in the aerosol-generating articles of the present invention, the aerosol-generating substrate is circumscribed by a wrapper. The wrapper may be formed of a porous or non-porous sheet material. The wrapper may be formed of any suitable material or combination of materials. Preferably, the wrapper is a paper wrapper.

In addition, aerosol-generating articles in accordance with the invention comprise at least one heat-expandable element disposed on the outer surface of the wrapper.

Preferably, at least one heat-expandable element comprises a heat reactive material. As used herein, the term "heat reactive material" is used to describe a material which changes shape or state of matter when exposed to heat. This includes materials which remain in the changed shape or state of matter when no longer exposed to heat, as well as materials which return to their undeformed shape or previous state of matter when no longer exposed to heat.

As used herein, the term "deform" is used to describe the change of shape, dimensions, or shape and dimensions of an object, either elastically or plastically. This includes expansion and contraction.

More preferably, the heat reactive material is an intumescent reactive material.

The intumescent material may comprise any suitable material or materials. In certain embodiments, the intumescent material forms an insulating foam when exposed to heat from the combustion zone of a smoking article. In one embodiment, the intumescent material comprises a carbon source, such as starch or one or more pentaerythritols (or other types of polyalcohol), an acid source, such as ammonium polyphosphate, a blowing agent such as melamine, and a binder, such as soy lecithin. Additionally an agent that enhances the formation of the insulating foam could be added, such as chlorinated paraffins. In an alternative embodiment, the intumescent material comprises a mixture of sodium silicate and graphite such that a hard char foam may be produced when the intumescent material is exposed to heat during use of the aerosol-generating article.

The intumescent material may be applied as a heat reactive coating formed by applying one or more intumescent varnishes, paints, lacquers, or any combination thereof on an interior surface of the cap body. For example, by brushing, rolling, dipping or spraying or by using intumescent paper or plastic-based sheet that is formed into the final shape of the cap by any known cap manufacturing processes, such as cutting, rolling and gluing systems or moulding in the case of plastic-based material. In one embodiment, the intumescent material is a latex solution applied by spraying.

Preferably, upon heating the at least one heat-expandable element expands radially by at least about 0.01 millimetres. Radial expansion of the heat-expandable element is measured by heating the aerosol-generating article under such conditions that nothing is physically preventing or limiting the thermal expansion. It will be appreciated that, by contrast, when an aerosol-generating article in accordance with the invention is heated within the heating chamber of an aerosol-generating device, the extent of the expansion may be limited by the cooperation of the heat-expandable element with the walls of the heating chamber.

More preferably, upon heating the at least one heat-expandable element expands radially by at least about 0.05 millimetres. Even more preferably, upon heating the at least one heat-expandable element expands radially by at least about 0.1 millimetres.

In addition, or as an alternative, upon heating the at least one heat-expandable element preferably expands radially by less than about 1 millimetre. More preferably, upon heating the at least one heat-expandable element expands radially by less than about 0.75 millimetres. Even more preferably, upon heating the at least one heat-expandable element expands radially by less than about 0.5 millimetres.

Preferably, upon heating the heat reactive material expands by at least about 1.1 times. As used herein, the term "expands by at least 1.1 times" is used to meant that, when exposed to heat, an element made of the heat reactive material having a thickness of 1 millimetre in the non-deformed state preferably expands to a thickness of at least about 1.1 millimetres. Expansion of the heat-expandable element is measured by heating the aerosol-generating article under such conditions that nothing is physically preventing or limiting the thermal expansion.

More preferably, upon heating the heat reactive material expands by at least about 2 times. Even more preferably, upon heating the heat reactive material expands by at least about 5 times. Most preferably, upon heating the heat reactive material expands by at least about 10 times.

Preferably, an aerosol-generating article in accordance with the invention expands by at least about 1.001 times. In other words, an aerosol-generating article having, in the non-deformed state, an outer diameter of about 7 millimetres at the location of the at least one heat-expandable element will, when exposed to heat, expand to an outer diameter of at least about 7.01 millimetres. More preferably, the aerosol-generating article expands by at least about 1.007 times. Even more preferably, the aerosol-generating article expands by at least about 1.014 times.

In addition, or as an alternative, the aerosol-generating article expands by less than about 1.14 times. More preferably, the aerosol-generating article expands by less than about 1.107 times. Even more preferably, the aerosol-generating article expands by less than about 1.07 times.

Preferably, a length of the heat-expandable element is at least about 0.5 millimetres. Throughout the specification, the term "length" is used to denote the dimension of a component of the aerosol-generating article as measured in the longitudinal direction of the article. More preferably, a length of the heat-expandable element is at least about 1 millimetre. Even more preferably, a length of the heat-expandable element is at least about 2 millimetres.

In addition, or as an alternative, a length of the heat-expandable element is preferably less than about 15 millimetres. More preferably, a length of the heat-expandable element is less than about 10 millimetres. Even more preferably, a length of the heat-expandable element is less than about 5 millimetres.

Preferably, a surface area of the of a region of the outer surface of the wrapper covered by the heat-expandable element is at least about 7.5 square millimetres. More preferably, a surface area of the of a region of the outer surface of the wrapper covered by the heat-expandable element is at least about 15 square millimetres. Even more preferably, a surface area of the of a region of the outer surface of the wrapper covered by the heat-expandable element is at least about 30 square millimetres.

In addition, or as an alternative, a surface area of the of a region of the outer surface of the wrapper covered by the heat-expandable element is preferably less than about 600 square millimetres. More preferably, a surface area of the of a region of the outer surface of the wrapper covered by the heat-expandable element is less than about 400 square millimetres. Even more preferably, a surface area of the of a region of the outer surface of the wrapper covered by the heat-expandable element is less than about 200 square millimetres.

In some embodiments, the at least one heat-expandable element extends about the circumference of the wrapper. In alternative embodiments, the aerosol-generating article comprises a plurality of discrete heat-expandable elements disposed at distinct locations about the circumference of the wrapper.

Preferably, the heat reactive material is disposed homogenously about the circumference of the wrapper. This is advantageous in that centring of the aerosol-generating article within the heating chamber is favoured. Without wishing to be bound by theory, it is understood that, if the aerosol-generating article is inserted into the heating chamber in a position other than the coaxial position, a portion of the heat-expandable element will be closer to the heat source than the remainder of the heat-expandable element and, as such, will generally expand faster than the remainder of the heat-expandable element. Cooperation of the expanded portion of the heat-expandable element with a portion of the wall of the heating chamber is expected to cause the heat-expandable element to shift inside the heating chamber towards a more central position.

In some embodiments the at least one heat-expandable element may comprise a first layer comprising a first heat reactive material and a radially outer second layer adjoining the first layer comprising a second heat reactive material. A thermal expansion coefficient of the first heat reactive material is smaller than a thermal expansion coefficient of the second heat reactive material. In some embodiments, the thermal expansion coefficient of the first reactive material, that is, the thermal expansion coefficient of the layer radially closest to the wrapper may even be negative. In other words, the first reactive material may even contract upon heating, provided that the heat-expandable element as a whole does expand upon exposure to heat during use of the aerosol-generating article. Without wishing to be bound by theory, it is understood that in these embodiments the heat-expandable element may curve and bend outwards.

By way of example, in embodiments wherein the heat-expandable element comprises two or more layers having different thermal expansion coefficients, the heat-reactive material or materials may be selected among bimetals, shape memory alloys and combinations thereof. In the case of bimetals, the layer with the larger thermal expansion coefficient is also referred to as the "active component" and may comprise an alloy containing two or more of nickel, iron, manganese and chrome. The layer with the smaller thermal expansion coefficient is also referred to as the "passive component" and may comprise an iron-nickel alloy, such as for example Invar®, a 36 percent nickel-iron alloy that displays a near zero thermal expansion coefficient.

Preferably, a distance between the at least one heat-expandable element and a mouth end of the aerosol-generating article is greater than about 50 percent of an overall length of the aerosol-generating article. Thus, the at least one heat-expandable element is closer to the distal end of the article, which is meant to maximise the impact of the cleaning action when the article is extracted from the heating chamber of the aerosol-generating device after use. More preferably, a distance between the at least one heat-expandable element and a mouth end of the aerosol-generating article is greater than about 60 percent of an overall length of the aerosol-generating article. Even more preferably, a distance between the at least one heat-expandable element and a mouth end of the aerosol-generating article is greater than about 70 percent of an overall length of the aerosol-generating article.

In addition, or as an alternative, a distance between the at least one heat-expandable element and a mouth end of the aerosol-generating article is preferably less than about 95 percent of an overall length of the aerosol-generating article. More preferably, a distance between the at least one heat-expandable element and a mouth end of the aerosol-generating article is less than about 85 percent of an overall length of the aerosol-generating article.

In particularly preferred embodiments a distance between the at least one heat-expandable element and a mouth end of the aerosol-generating article is from about 50 percent to about 95 percent of an overall length of the aerosol-generating article, more preferably from about 60 percent to about 85 percent of an overall length of the aerosol-generating article. Aerosol-generating articles comprising the heat-expandable element at a distance from the mouth-end falling within these ranges advantageously combine a satisfactory cleaning effect with a particularly stable and balanced positioning of the aerosol-generating article within the heating chamber of the aerosol-generating device.

Further, such aerosol-generating articles may be particularly advantageous when used in an aerosol-generating device comprising an inductive heater. In one such aerosol-generating device, the heater may comprise: a pin extending into the heating chamber and operatively coupled with an induction coil arranged along the pin; and a power source connected to the induction coil and configured to provide a high frequency current to the induction coil. In one such arrangement, the heat-expandable element provides a desirable restricting and blocking effect.

Preferably, a distance between the at least one heat-expandable element and a heat source of the aerosol-generating article is less than about 20 millimetres. More preferably, the distance between the at least one heat-expandable element and the heat source is less than about 10 millimetres. Even more preferably, the distance between the at least one heat-expandable element and the heat source is less than about 5 millimetres.

Preferably a thickness of the at least one heat-expandable element in a non-deformed state is at least about 0.05 millimetres. More preferably, a thickness of the at least one heat-expandable element in a non-deformed state is at least about 0.1 millimetres. Even more preferably, a thickness of the at least one heat-expandable element in a non-deformed state is at least about 0.2 millimetres. In addition, or as an alternative, a thickness of the at least one heat-expandable element in a non-deformed state is preferably less than about 2 millimetres.

The aerosol-generating articles according to the invention preferably comprise one or more elements in addition to the rod of aerosol-generating substrate. The rod and the one or more elements may be assembled within the same substrate wrapper. For example, aerosol-generating articles according to the invention may further comprise at least one of: a mouthpiece, an aerosol-cooling element and a support element such as a hollow acetate tube. For example, in one preferred embodiment, an aerosol-generating article comprises, in linear sequential arrangement, a rod of aerosol-generating substrate as described above, a support element located immediately downstream of the aerosol-generating substrate, an aerosol-cooling element located downstream of the support element, the wrapper circumscribing the rod, the support element and the aerosol-cooling element.

It will be understood that, in aerosol-generating articles comprising one or more elements in addition to the rod of aerosol-generating substrate circumscribed by a wrapper, the heat-expandable element disposed on the outer surface of the wrapper may be at a location along the aerosol-generating substrate or at a location along one of the one or more additional elements.

Depending on the overall length of the aerosol-generating article, positioning the heat-expandable element at a location along one of the one or more additional elements may further stabilise the aerosol-generating article within the heating chamber. On the other hand, positioning the heat-expandable at a location along the aerosol-generating substrate will generally enhance the cleaning effect linked with the removal of the aerosol-generating article from the heating chamber.

In some embodiments, the aerosol-generating article may comprise a further outer wrapper circumscribing the heat-expandable element. Thus, in such embodiments the heat-expandable element overlies the wrapper circumscribing at least the rod of aerosol-generating substrate and underlies the outer wrapper. This may be desirable in that the heat-expandable element is not visible and the aerosol-generating article is provided with a smoother outer finish. This may, in turn, facilitate the handling and packaging of the aerosol-generating articles.

Aerosol-generating articles as described above can be used in combination with electrically operated aerosol-generating devices. In more detail, an aerosol-generating system in accordance with the invention comprises an aerosol aerosol-generating article and an electrically operated aerosol-generating device, wherein the aerosol-generating device comprises a heater and an elongate heating chamber configured to receive the aerosol-generating article so that the aerosol-generating article is heated in the heating chamber. The aerosol-generating article comprises a rod of aerosol-generating substrate, a wrapper circumscribing the rod, and at least one heat-expandable element disposed on the outer surface of the wrapper, as described above. An outer diameter of the circumscribed rod is less than an inner diameter of the heating chamber. Further, the heat-expandable element is configured to deform when heated in the heating chamber such that at least part of the heat-expandable element engages an inner surface of the heating chamber.

Thus, during use, the aerosol-generating article is advantageously held in place within the heating chamber and so the likelihood of the aerosol-generating article slipping out of the heating chamber is significantly reduced.

Preferably, the heater comprises a substantially cylindrical, elongate heating element and the heating chamber is disposed about a circumferential, longitudinal surface of the heater. Accordingly, during use, the thermal energy supplied by the heater travels radially outwards from a surface of the heater into the heating chamber and the aerosol-generating article.

Thus, the positioning of the aerosol-generating article within the heating chamber can be even more finely controlled. In particular, the aerosol-generating article can centred and made substantially coaxial with the heating chamber, such that a distance between the outer surface of the aerosol-generating article and the wall of the heating chamber is substantially constant about the circumference of the aerosol-generating article. This advantageously ensures a more homogeneous transfer of heat from the heater to the aerosol-generating substrate during use, thereby reducing the likelihood of hot spots within the substrate.

However, other shapes and configurations of the heater and heating chamber can alternatively be used.

The heater may comprise a plurality of individual heating elements, the various heating elements being operable independently of one another so that different elements can be activated at different times to heat the aerosol-generating article. By way of example, the heater may comprise a plurality of axially aligned heating elements, which provide a plurality of independent heating zones along the length of the heater. Each heating element may have a length significantly less than the overall length of the heater. Thus, when one individual heating element is activated, it supplies thermal energy to a portion of the aerosol-generating substrate located radially in the vicinity of the heating element without substantially heating the remainder of the aerosol-generating substrate. Thus, different sections of the aerosol-generating substrate may be heated independently and at different times. By way of example, it may be possible to control activation of the heater such that, during use, a heating element arranged at an axial location facing in use the heat-expandable element is activated first. Thus, the aerosol-generating article can be immediately stabilised and held in place within the heating chamber before the generation of aerosol begins in full.

As an alternative, or in addition, the heater may comprise a plurality of elongate, longitudinally extending heating elements at different locations around the longitudinal axis of the heater. Thus, when one individual heating element is activated, it supplied thermal energy to a longitudinal portion of the aerosol-generating substrate lying substantially parallel and adjacent to the heating element. This arrangement also allows for the independent heating of the aerosol-generating substrate in distinct portions.

In preferred embodiments, the aerosol-generating system further comprises an insulation means arranged between the heating chamber and an exterior of the apparatus to reduce heat loss from heated aerosol-generating substrate.

The invention will now be further described with reference to the figures in which.

Figure 1:
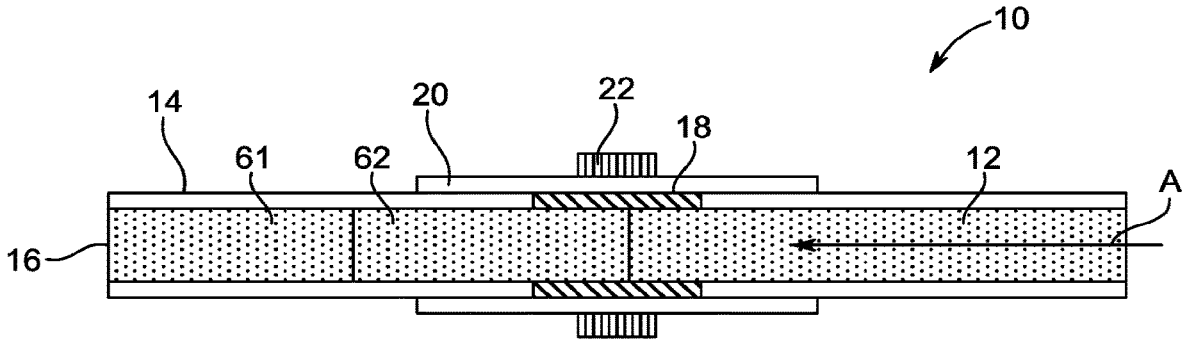
FIG. 1 shows a schematic sectional side view of an aerosol-generating article in accordance with the present invention.

The aerosol-generating article 10 shown in FIG. 1 comprises a rod 12 of aerosol-generating substrate and a wrapper 14 circumscribing the rod 12. An arrow A indicates the direction of flow of the aerosol during use, such that a mouth end 16 of the rod 12 is identified, along with a support element 62 located immediately downstream of the rod 12 of aerosol-generating substrate, and an aerosol-cooling element 61 located downstream of the support element 62.

In the embodiment of FIG. 1, a portion of the rod 12 is further circumscribed by a band of pressure-resistant paper 18, which is joined to other portions of the wrapper 14 by another band 20 of wrapper paper.

Further, the aerosol-generating article 10 comprises a heat-expandable element 22 disposed on the outer surface of the band 20 of wrapper paper. The heat-expandable element 22 is made of an intumescent reactive material which is adapted to expand about 10 times its original dimensions when exposed to heat. The heat-expandable element 22 is provided as an annular element extending about the circumference of the band 20 of wrapper paper, such that the intumescent material is disposed homogeneously about the circumference of the wrapper.

Figure 2:
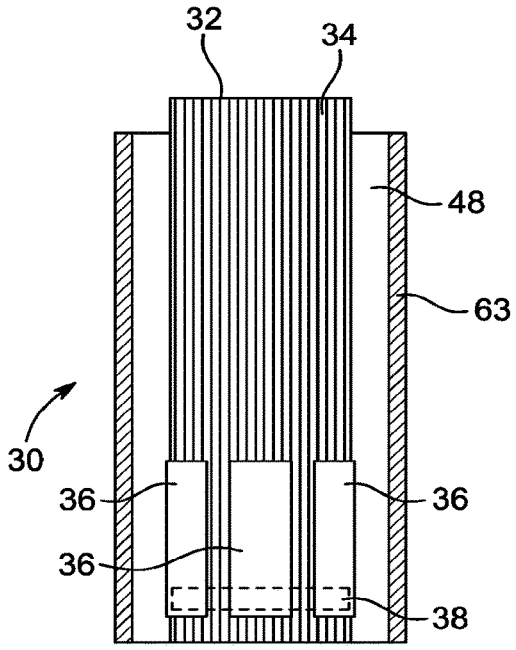
FIG. 2 shows a schematic sectional side view of an aerosol-generating article in accordance with the present invention received within the heating chamber of an aerosol-generating device prior to the administration of thermal energy.
Figure 3:
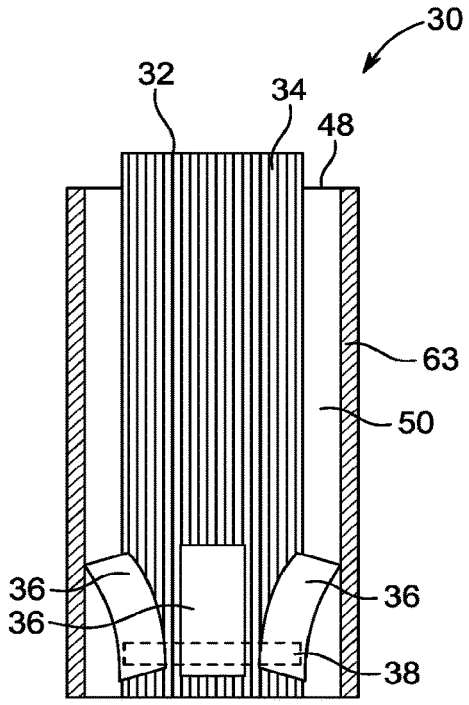
FIG. 3 shows a schematic sectional side view of the aerosol-generating article of FIG. 2 following administration of thermal energy.

FIGS. 2 and 3 illustrate another embodiment of an aerosol-generating article 30 in accordance with the invention. The aerosol-generating article 30 comprises a rod 32 of aerosol-generating substrate and a wrapper 34 circumscribing the rod 32. Further, the aerosol-generating article 30 comprises a plurality of heat-expandable elements 36 disposed on the outer surface of the wrapper 34. The heat-expandable elements 36 are arranged substantially equally spaced about the circumference of the wrapper 34. The heat-expandable elements 36 are affixed onto the wrapper 34 by means of a layer of heat-resistant glue 38. Each heat-expandable element 36 comprises a first layer comprising a first heat reactive material and a radially outer second layer adjoining the first layer and comprising a second heat reactive material. A thermal expansion coefficient of the first heat reactive material is less than a thermal expansion coefficient of the second heat reactive material. The aerosol-generating article 30 is received in the heating chamber 50 of an aerosol-generating device 48. As shown in FIGS. 2 and 3, the aerosol-generating article 30 may include an insulation means via an external layer, such as insulator 63, around a periphery of the aerosol-generating device 48.

FIG. 2 shows the aerosol-generating article 30 prior to use, that is, prior to exposure to the heat of the aerosol-generating device 50. Thus, the heat-expandable elements 36 are shown in a non-deformed (that is, non-expanded) state. FIG. 3 shows the aerosol-generating article 30 during use, after exposure to heat sufficient to change the state of the heat-expandable element from non-deformed to expanded. Because of the different thermal expansion coefficients of the two heat reactive materials, the heat-expandable elements 36 assume a curved C-shaped configuration, such that they may contact the surface of the heating chamber at their respective ends, which effectively bend outwards from a central portion of the heat-expandable element.

Figure 4:
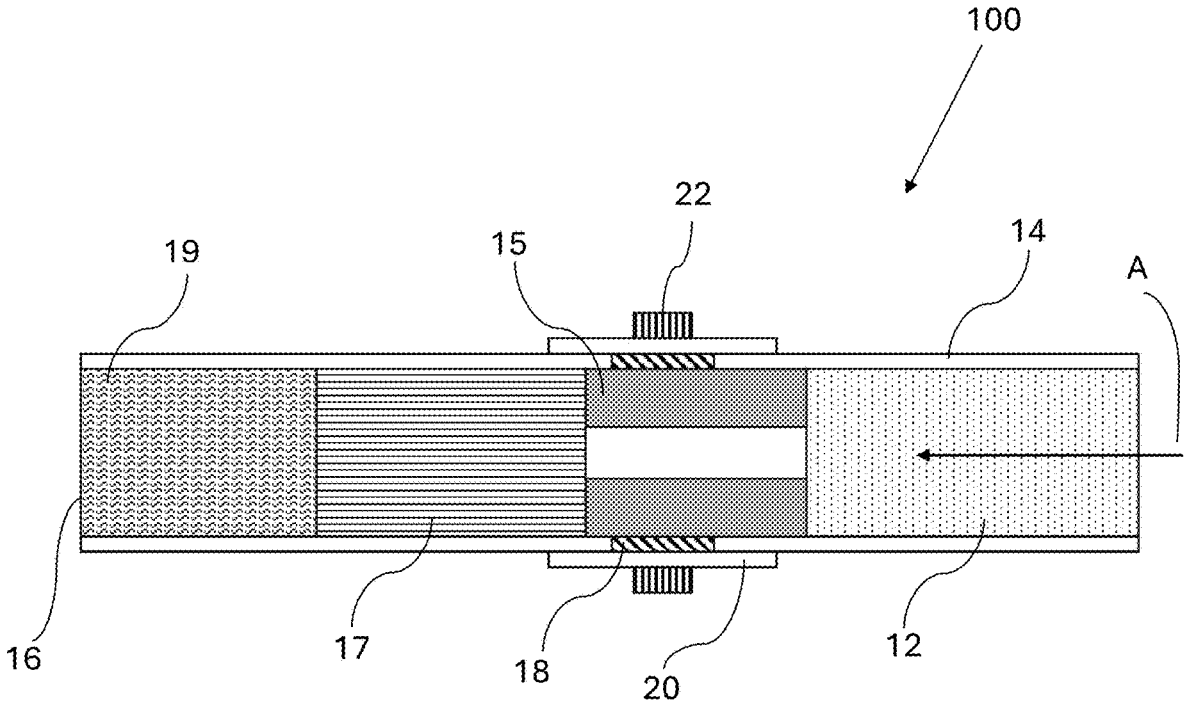
FIG. 4 shows a schematic sectional side view of a further aerosol-generating article in accordance with the present invention.

FIG. 4 shows a schematic sectional side view of a further aerosol-generating article 100 in accordance with the present invention. The aerosol-generating article 100 is similar to the aerosol-generating article 10 of FIG. 1 and like reference numerals are used to designate like parts.

The aerosol-generating article 100 comprises elements in addition to the rod 12 of aerosol-generating substrate. As shown in FIG. 4, the rod and the additional elements are assembled within the same wrapper 14. The aerosol-generating article 100 further comprises a mouthpiece 19 at a mouth end 16, an aerosol-cooling element 17 and a support element 15 such as a hollow acetate tube. The heat-expandable element 22 is disposed on the outer surface of the wrapper 14 at a location along the additional elements, in particular the support element 15.

The invention claimed is:

1. An aerosol-generating article for producing an inhalable aerosol when heated, the aerosol-generating article comprising:

a rod of aerosol-generating substrate;

at least one of a mouthpiece, an aerosol-cooling element, and a support element provided downstream of the rod of aerosol-generating substrate;

a wrapper circumscribing the rod and the at least one of the mouthpiece, the aerosol-cooling element, and the support element; and at least one heat-expandable element disposed on an outer surface of the wrapper at a location along the at least one of the mouthpiece, the aerosol-cooling element, and the support element, wherein the at least one heat-expandable element comprises a heat-reactive material configured to expand upon heating such that upon heating the at least one heat-expandable element expands radially by at least 0.01 millimeter.

2. The aerosol-generating article according to claim 1, wherein the heat-reactive material is an intumescent reactive material.

3. The aerosol-generating article according to claim 1, wherein the at least one heat-expandable element expands by between about 10 times and about 100 times its original dimensions when exposed to heat.

4. The aerosol-generating article according to claim 1, wherein the at least one heat-expandable element extends about a circumference of the wrapper.

5. The aerosol-generating article according to claim 1, wherein the at least one heat-expandable element comprises a plurality of heat-expandable elements disposed at distinct locations about a circumference of the wrapper.

6. The aerosol-generating article according to claim 1, wherein the heat-reactive material is disposed uniformly and continuously about a circumference of the wrapper.

7. The aerosol-generating article according to claim 1, wherein the at least one heat-expandable element further comprises a first layer comprising a first heat-reactive material and a radially positioned outer second layer adjoining the first layer comprising a second heat-reactive material, and wherein a thermal expansion coefficient of the first heat-reactive material is less than a thermal expansion coefficient of the second heat-reactive material.

8. The aerosol-generating article according to claim 1, wherein a distance between the at least one heat-expandable element and a mouth end of the aerosol-generating article is greater than about 50 percent of an overall length of the aerosol-generating article.

9. The aerosol-generating article according to claim 1, wherein a thickness of the at least one heat-expandable element in a non-deformed state is at least about 0.05 millimeter.

10. The aerosol-generating article according to claim 1, wherein the at least one of the mouthpiece, the aerosol-cooling element, and the support element comprise, in linear sequential arrangement, a support element disposed immediately downstream of the aerosol-generating substrate, an aerosol-cooling element disposed downstream of the support element, the wrapper circumscribing the rod, the support element, and the aerosol-cooling element.

11. The aerosol-generating article according to claim 1, wherein upon heating the aerosol-generating article expands radially by at least 1.001 times its original dimensions.

12. The aerosol-generating article according to claim 1, wherein the at least one heat-expandable element comprises a heat-reactive material configured to expand upon heating such that upon heating the at least one heat-expandable element expands radially by less than 1 millimeter.

13. An aerosol-generating system, comprising:

an aerosol-generating article; and an electrically operated aerosol-generating device comprising a heater and an elongate heating chamber configured to receive the aerosol-generating article so that the aerosol-generating article is configured to be heated in the elongate heating chamber, wherein the aerosol-generating article comprises:

a rod of aerosol-generating substrate, at least one of a mouthpiece, an aerosol-cooling element and a support element provided downstream of the rod of aerosol-generating substrate, a wrapper circumscribing the rod and the at least one of a mouthpiece, an aerosol-cooling element, and a support element, wherein an outer diameter of the circumscribed rod is less than an inner diameter of the elongate heating chamber, and at least one heat-expandable element disposed on an outer surface of the wrapper at a location along the at least one of a mouthpiece, an aerosol-cooling element and a support element, the at least one heat-expandable element comprising a heat-reactive material configured to expand upon heating, and the at least one heat-expandable element being configured to expand radially when heated in the elongate heating chamber by at least 0.01 millimeter, such that at least part of the at least one heat-expandable element engages an inner surface of the elongate heating chamber.

14. The aerosol-generating system according to claim 13, wherein the heater comprises a substantially cylindrical, elongate heating element and the elongate heating chamber is disposed about a circumferential, longitudinal surface of the heater.

15. The aerosol-generating system according to claim 13, further comprising an insulator arranged between the elongate heating chamber and an exterior of the aerosol-generating device configured to reduce heat loss from the rod of aerosol-generating substrate when heated.

* * * * *